US005984010A

United States Patent [19]

Elias et al.

[11] Patent Number: 5,984,010

[45] Date of Patent: Nov. 16, 1999

[54] HYDROCARBON RECOVERY SYSTEMS AND METHODS

[76] Inventors: Ramon Elias, 17519 Shelburne La., Spring, Tex. 77379; Michael Prats, 2834 Bellefontaine, Houston, Tex. 77025

[21] Appl. No.: 08/880,751

[22] Filed: Jun. 23, 1997

[51] Int. Cl.[6] ..... E21B 43/24

[52] U.S. Cl. ..... 166/272.3; 166/303

[58] Field of Search ..... 166/272.1, 272.3, 166/245, 305.1, 302, 303

[56] References Cited

U.S. PATENT DOCUMENTS

| | | | |
|---|---|---|---|
| 1,816,260 | 7/1931 | Lee . | |
| 3,874,452 | 4/1975 | Allen et al. | 166/260 |
| 3,881,775 | 5/1975 | McPherson | 299/18 |
| 4,044,830 | 8/1977 | VanHuisen | 166/267 |
| 4,067,391 | 1/1978 | Dewell | 166/303 |
| 4,296,969 | 10/1981 | Willman | 299/2 |
| 4,303,126 | 12/1981 | Blevins | 166/245 |
| 4,368,781 | 1/1983 | Anderson | 166/252 |
| 4,522,260 | 6/1985 | Wolcott, Jr. | 166/245 |
| 4,637,461 | 1/1987 | Hight | 166/245 |
| 4,645,003 | 2/1987 | Huang et al. | 166/245 |
| 4,662,441 | 5/1987 | Huang et al. | 166/245 |
| 4,682,652 | 7/1987 | Huang et al. | 166/263 |
| 4,685,515 | 8/1987 | Huang et al. | 166/50 |
| 4,702,314 | 10/1987 | Huang et al. | 166/245 |
| 4,718,485 | 1/1988 | Brown et al. | 166/50 |
| 4,828,031 | 5/1989 | Davis | 166/270.1 |
| 4,871,023 | 10/1989 | Nigrini et al. | 166/303 X |
| 4,915,169 | 4/1990 | Hwang et al. | 166/303 X |
| 5,085,276 | 2/1992 | Rivas et al. | 166/303 |
| 5,145,003 | 9/1992 | Duerksen | 166/272 |
| 5,305,829 | 4/1994 | Kumar | 166/272.3 X |
| 5,318,124 | 6/1994 | Ong et al. | 166/263 |
| 5,320,170 | 6/1994 | Huang et al. | 166/245 |
| 5,415,231 | 5/1995 | Northrop et al. | 166/303 |
| 5,511,616 | 4/1996 | Bert | 166/272 |
| 5,607,016 | 3/1997 | Butler | 166/263 |
| 5,607,018 | 3/1997 | Schuh | 166/303 |
| 5,636,903 | 6/1997 | Dickerson et al. | 299/36.1 |

OTHER PUBLICATIONS

A New Concept For Improving Steamflood Performance in Shallow Heavy Oil Reservoirs, Sarkar et al, SPE/DOE 35417, Apr. 1996.

Infill Drilling In A Steamford Operation: Kern River Field, Restine et al, SPE Reservoir Eng., May 1987.

Permeability Damage In Diatomite Due To Insitu Silica Dissolution/Precipitation, Koh et al, SPE/DOE 35394, Apr. 1996.

Interpretation Of Steam Drive Pilots In The Belridge Diatomite, Johnston et al, SPE 29621, Mar. 1995.

(List continued on next page.)

*Primary Examiner*—Roger Schoeppel
*Attorney, Agent, or Firm*—Guy McClung

[57] ABSTRACT

A method has been invented for recovering hydrocarbons from an earth formation containing hydrocarbons, the method including injecting a recovery injectant (e.g., but not limited to, saturated or supersaturated steam), into the earth formation at a plurality of injection points, the injection points spaced apart in one particular aspect by about 14 to about 208 feet, and producing hydrocarbons from the formation with at least one producer well extending into the formation. In one aspect the method includes injecting steam into an earth formation which contains oil bearing diatomite at a plurality of injection points spaced apart, in one aspect, by about 14 to about 208 feet, and producing hydrocarbons from the formation with a one or more producer wells extending into the oil bearing diatomite formation, with a plurality of producer wells spaced apart by a distance ranging between about 14 to about 149 feet, injecting steam into the oil bearing diatomite at an injection rate of between about 10 to about 149 barrels of steam per day per hundred feet thickness of diatomite, and injecting the steam at a pressure between about 10 p.s.i. to about 260 p.s.i. (or up to about 600 psi). The present invention also discloses a method for treating a hydrocarbon-bearing diatomite formation including applying an artificial overburden over at least a portion of the formation and applying a concept of variable well spacing as needed.

20 Claims, 13 Drawing Sheets

OTHER PUBLICATIONS

Correlations For Predicting Oil Recovery by Steamflood, Gomaa, SPE 6169, Oct. 1976.

Unconventional Steamflood In A Layered Dipping Reservoir, Abad, SPE 11693, Mar. 1983.

Analysis Of Hydrofracture Geometry and Matrix/Fracture Interactions During Steam Injection, Kovscek et al, SPE/DOE 35396, Apr. 1996.

Interpretation of Hydrofracture Geometry Using Temperature Transients I: Model Formulation and Verification, Kovscek et al, Dec. 1995.

Linear Transient Flow Solution for Primary Oil Recovery With Infill and Conversion to Water Injection, Zwahlen et al, Dec. 1995.

Interpretation of Hydrofracture Geometry Using Temperature Transients II: Asymmetric Hydrofractures, Kovscek et al, Dec. 1995.

Plan
2-1/2 Versus 1/16th Acre Spacing
330 feet versus 55 feet producer to producer spacing.
P
I
14
12
14
14
14
P Elevation
Distance between injector and producer equals about 39 feet.
14
12
14
Top Diatomite
Base Diatomite Injector A Injector B
ground level
I
I
73
78
70
72
72
72
72
71
83
84
88
80
81
82
82
82
86
86
86
86
86
86

Producer

Artificial Overburden Seal and Vent System

Variable Spacing Option

HYDROCARBON RECOVERY SYSTEMS AND METHODS

BACKGROUND OF THE INVENTION

1. Field of the Invention

This invention is directed to systems and methods for recovering hydrocarbons from the earth, and in one particular aspect to such recovery from diatomaceous and other hydrocarbon-bearing rock occurring at shallow depths and sometimes outcropping at the surface; to such systems and methods using recovery techniques involving the injection of substances and/or materials that improve the hydrocarbon recovery performance such as but not limited to steam injection; and, in one particular aspect, to such systems and methods including an artificial shield on a formation for reducing or eliminating the escape of injected materials and/or substances and/or pollutants to the surface and/or environment. In one aspect, the present invention is directed to a recessed wellhead system.

2. Description of Related Art

The prior art discloses knowledge of a variety of known liquid and solid hydrocarbon deposits that have not been exploited because of unfavorable economics or unavailable and/or inadequate technology. "Diatomaceous earth", "diatomaceous oil shale", and "diatomaceous rock" occurring at very shallow depths—collectively referred to herein as "diatomite"—is one type of this relatively unexploited unconventional petroleum resource. Diatomite is composed of the siliceous skeletal remains of single-celled marine plants or algae called "diatoms". There are known extensive deposits of hydrocarbon-bearing diatomite in California.

One such deposit is in the McKittrick Field in western Kern County, California situated in the northwestern end of a relatively narrow band of rich oil-bearing diatomite. The band is about 17 miles long and about one mile wide. It is estimated that the McKittrick area, one of the many areas of interest to which this invention applies, may contain over 800 million barrels of oil.

The majority of diatomite in the McKittrick Field occurs from the surface down to a depth of about 2000 feet, total vertical depth. Close to the surface, the accumulation tends to mainly consist of what is referred to as Opal A diatomite rock sometimes mixed with other sediment and rock material types. In addition, high concentrations of high viscosity and high density crude oil is also contained herein.

Opal A diatomite is known to have characteristics of very low permeability and very high oil concentrations when compared with conventional heavy oil-bearing sandstone rock successfully being developed in the area. However, the combination of very low rock permeability and high crude oil viscosity make it extremely difficult or virtually impossible to develop and produce this resource using conventional exploitation methods. This is confirmed by very limited and virtually non-existent resource development by operators owning rights to the resource accumulations.

Diatomite rock tends to change in characteristic form depending on the temperature at which the accumulation occurs and the amount of non-diatomite material that may be present. The higher the temperature and the more non-diatomite material present, the greater the tendency is for this change to occur. Since normal formation temperatures increase with depth according to the local geothermal gradient, observed diatomite form changes can be expected to behave accordingly. The resulting transformation is a more stable crystalline form often referred to as Opal CT.

Opal CT normally begins to occur at depths ranging from 1000 to 2000 feet. The transformation is usually complete below the lower depth. One possible exception to this somewhat ordered tendency is the movement or displacement of the rock material caused by localized tectonic events such as faulting. These events can produce a re-ordering of the material and a perceived exception to the ordered behavior discussed above when compared with an undisturbed accumulation.

Opal A is amorphous non-crystalline diatomite composed of substantially unaltered and rubblized diatom fossils with a porosity of about 55% to about 70% and a permeability of tens of millidarcies. Opal CT diatomite is composed substantially of diagenetically-altered and broken diatom fossils with a porosity of about 35% to about 55% and a permeability of about one to about five millidarcys.

The unaltered nature of the Opal A diatomite fossils insures that not only are there hydrocarbon deposits in the voids between adjacent fossils, but also deposits in the voided fossil shell previously occupied by the soft parts of the living organism which comprises a large part of the diatom frustule volume.

Intact diatoms often settled in a hydrodynamically stable position on the ocean floors eons ago. This tends to result in a more regular, layered deposit, thus contributing further to the increased porosity of Opal A diatomite and its accompanying increased capacity for hydrocarbons.

Accordingly, a formation composed of Opal A diatomite tends to hold more hydrocarbons per unit bulk volume than a formation composed of Opal CT diatomite. Furthermore, Opal A and Opal CT diatomite forms contain significantly more hydrocarbons per unit bulk volume than a formation composed of predominantly sandstone rock material.

Generally speaking, the McKittrick diatomite typifies much of the oil bearing shallow diatomite occurring in California including but not limited to the following general characteristics: a cover of overburden that varies from nothing at various surface outcroppings to hundreds of feet of thickness; a vertical formation thickness ranging from a few feet to well over 1,200 feet; a formation base extending from the surface to depths of about 1000 to 2000 feet; an average porosity of about 65%; a permeability range of about 5 to 50 millidarcys; viscosity of the oil contained herein of about 3000 centipoise; and an oil concentration of as much as 2800 barrels per acre-foot. One area of interest in McKittrick is about 1680 acres—i.e., this oil accumulation contained in diatomite is relatively small in areal extent when compared with conventional heavy oil accumulations contained in sandstone rock. Yet, very limited and virtually non-existent resource development by operators owning rights to the resource accumulations has ever occurred.

The prior art discloses that a variety of hydrocarbon extraction methods have been considered for McKittrick and other shallow diatomite fields including, but not limited to, steam injection; hydraulic fracturing; and strip mining.

Hydraulic fracturing of the shallow McKittrick diatomite may produce ruptures to the surface, which may endanger personnel, cause oil spills, and vent hydrocarbon and other gases to the atmosphere.

Strip mining or open pit mining using solvent or retort extraction for the McKittrick diatomite may result in large volumes of gases dissolved in the crude being released to the atmosphere as new ore is exposed and the fluid pressure is released as the overburden is removed.

Regarding steam injection, the differences between conventional methods and what is disclosed in one particular embodiment of the present invention is presented by means of an example regarding the effects of the concentration of the resource and of the formation properties and the effect on pattern spacing.

Example I compares the oil-in-place in a representative 2.5 acre area in Kern River (a conventional field operation) and a 0.156 acre area in the McKittrick Field diatomite. With the units shown in the examples, oil-in-place is calculated to be the product shown below:

Oil-In-Place = 0.7758 × Porosity × Oil Saturation × Thickness × Drainage Area

EXAMPLE 1 - OIL CONCENTRATION

| | CONVENTIONAL SPACING (e.g. KERN RIVER FORMATION) | INVENTION SPACING (e.g. McKITRICK DIATOMITE FORMATION) |
|---|---|---|
| Porosity, % | 30 | 65 |
| Initial Oil Saturation, % | 50 | 55 |
| Formation Thickness, feet | 60 | 403 |
| Drainage Area, acres | 2.5 | 0.156 |
| Oil-In-Place, barrels | 174,555 | 174,555 |
| Concentration, barrels/acre | 69,822 | 1,117,152 |

Barrels in Example 1 above are at surface conditions and assume a formation volume factor very close to 1.0 reservoir barrel per stock tank barrel.

Example 1 shows the same amount of oil-in-place in both the diatomite formation (with well spacing according to one aspect of the present invention) and with prior art well spacing in a typical unconsolidated sandstone formation, even though the pattern or drainage area for the diatomite is 1/16 (=2.5/0.156) the area of the typical formation. The oil concentration in barrels per acre in a given zone is 16 times larger for the diatomite than for a typical unconsolidated sandstone operation—1,117,152 barrels per acre versus 69,822 barrels per acre, respectively.

Prior art has not considered, recognized, suggested, or addressed this small well spacing in the diatomite. Yet, the low permeability and the low fluid pressure seen in the shallow diatomite indicate to the present inventors that small well spacing is needed to drain the available reserves over a reasonable period of time. Implementing this approach in a formation with the uniquely high oil concentration as seen in the diatomite supports the need to go to smaller spacing. This invention addresses this and other related considerations needed to make such a process feasible.

SUMMARY OF THE PRESENT INVENTION

The present invention, in certain embodiments, discloses a method for hydrocarbon recovery from an earth formation which includes injecting steam at multiple injection points, regularly or irregularly spaced apart randomly or in a pattern, that are relatively close together, e.g. between about 14 to about 208 feet apart, in one aspect between about 25 to about 150 feet apart, and in one embodiment about 82.5 feet apart; and, in one aspect, with a well density of at least 6, 5, 4, 3, or 2 wells per acre and in one aspect at least 2 wells per acre. The present inventors are unaware of any prior art involving injector spacing closer than approximately 208 feet apart resulting in injector and producer spacing in an enhanced recovery operation closer than approximately 148 feet assuming a 5-spot configuration. Producing wells according to the present invention are similarly spaced, slightly more or less, depending on well placement configurations and pattern shapes. With such injector and producer spacing, an acre of a producing field according to the embodiment of the present invention has about 1 injector and, a corresponding number of producers if a five-spot configuration is assumed. The development of the diatomite of Example I according to one embodiment of the present invention has 16 times the number of wells per acre as a typical prior art operation while maintaining about the same well cost per barrel of oil-in-place.

The present invention, in certain embodiments, discloses, among other things, a steam injection method (using in certain aspects either saturated or supersaturated steam) for the production of hydrocarbons from an earth formation in which about 10 to about 149 (and in one aspect about 15 to about 65) barrels of steam per day per one hundred feet of shallow heavy oil bearing diatomite thickness per pattern are injected through each injector into the formation. The present inventors are unaware of any known process that uses steam injected at such low rates.

The lowest steam injection rate deliberately used in any process known to the present inventors is greater than approximately 149 barrels of steam per day per one hundred feet of interval per acre per injector. Higher steam injection rates cannot be used for effectively and safely producing hydrocarbons from diatomite unless, according to the present invention the confining pressure is sufficient to prevent steam from escaping to the atmosphere via induced fractures and dangerous surface eruptions.

The present invention, in certain embodiments, discloses methods for hydrocarbon removal from an earth formation using steam injection at pressures as low as about 10 psi and in another aspect between 10 and 260 psi. In one aspect the steam injection rates at the higher end of this range are variable depending on producing strategies and the upper limit of the confining steam load. The present inventors are unaware of any prior art process in which steam is deliberately injected at this relatively low pressure, particularly at the start, for the injection rates discussed above. The present inventors are not aware of any prior art that combines this relatively low pressure and relatively low rate approach for hydrocarbon recovery when relatively low permeability and high oil viscosity are present. The prior art is basically driven by achieving maximum injection rates and pressures for wells placed on much wider spacing than prescribed by this invention when sufficient confining pressure is available.

Typically an average of 5 to 6 cubic feet of natural gas and/or other gasses will be liberated to the atmosphere when 1 barrel of heavy oil having the approximate characteristics as that seen in the McKittrick diatomite is produced by methods such as strip or open pit mining. In other systems in which pressure on an oil-bearing formation is reduced, e.g. by hydrocarbon production, gas liberation always occurs. Provision of an artificial overburden according to the present invention results in a "closed" system for oil (or other hydrocarbons) production to contain the liberated gas.

The present invention, in certain embodiments, discloses a method in which an artificial overburden is used to reduce or eliminate the escape of injectant, undesirable gases and/or other pollutants, including crude oil, into the environment; to remove hydrocarbons from an earth formation under controlled conditions; and to provide an adequate confining load. In the extreme case of a vertical formation outcrop, one aspect would be to excavate a sufficient quantity of material to create a horizontal surface on which to construct the appropriate amount of overburden needed to effect confinement. This assumes the heavy oil bearing formation that is outcropping to the surface extends downward into the earth at some angle more than zero degrees. The artificial overburden may be permanent or removable. The artificial overburden, in certain aspects, includes: an amount of soil, clay, dirt, cement, concrete, gravel, sand, and/or rock; containers (e.g. but not limited to barrels, cans, bottles, bladders, or insulated chests) of material, liquid and/or solid; solid objects; blankets and/or fabrics made of natural and/or synthetic materials, e.g. but not limited to, plastic, fiberglass, metal, ceramic, cellulose, adhesives, and any combination thereof constructed in such a way to encourage seal integrity both within the artificially constructed material as well as to the pre-existing overburden material to which a seal is made including packing, reinforcing, gluing, and binding. The present invention applies to other advanced and/or enhanced oil recovery process with steam injection being but an example of its effectiveness.

Systems according to the present invention can potentially deplete a formation of diatomite over a reasonably short time period which is comparable or less than reservoir depletion of typical conventional formations. Use of systems according to the present invention in relatively consolidated vertically and horizontally diatomite results in 10 to 50 percent more efficient use of heat including a significant reduction in heat loss.

The present invention, in certain embodiments, discloses a below-grade wellhead system; a container for a below-grade wellhead; such a wellhead with appropriate covering which can support significant weight, such as the weight of a large truck or other vehicle; and a field or area with a plurality of such wellheads. The present invention teaches a variety of reinforced cellars or containers useful with such below-grade wellheads.

The present invention, in certain aspects, discloses methods and systems for the removal of heavy oil from formations, including but not limited to diatomite formations, and any other similar situation, such methods and systems using some or all of the previously-mentioned systems, i.e., methods employing injectors and producers arranged and located in Mini-Patterns; steam injection at relatively low rates; steam injection at relative low pressures; the use of an artificial overburden over areas of relatively shallow deposits; and the use of below-grade wellheads and appropriate reinforcements for them.

Such methods and systems are useful in various diatomite formations in which heavy oil is very concentrated as compared to heavy oil in other formations. Certain embodiments of the present invention result in the production of the bulk (55 to 70%) of the oil from the formation volume within active well patterns in a relatively short period of time, e.g. five years more or less. Also such methods and systems generally are associated with lower steam and operating temperatures, lower steam injection rates, lower operating pressures, less robust equipment, and relatively smaller flow lines than conventional heavy oil projects—which all result in low costs, excellent oil recovery efficiency, and manageable safety considerations.

Systems and methods according to the present invention, with some or all of the inventions described above, may be used to produce hydrocarbons from any formation although the applicability in some instances is limited by economic considerations. In certain aspects, such systems and methods are used to produce relatively heavy oils; to produce hydrocarbons from relatively concentrated deposits; and, in certain preferred embodiments, to produce heavy oil from diatomite.

The effect of formation properties on steam injection is illustrated by considering a well known equation provided by Muskat for one incompressible fluid, relating the distance between injector and producer (d, in feet, from which the pattern area A, in acres, can be obtained), the fluid mobility (k/m, where k is the permeability of the formation in millidarcies and m is the fluid viscosity in centipoise), and the maximum pressure drop between injector and producer (which is proportionally related to the depth D, in feet), on the calculated injection and production rates (q, in barrels per day per 100 feet of formation thickness) for an idealized 5-spot well pattern:

$$q = \frac{0.0230(k/\mu)D}{\ln(d/r_w)0.6174} = \frac{0.0460(k/\mu)D}{\ln(A/r_w^2)+8.754}.$$

In the equation, ln is the natural logarithm, and $r_w$ is the well radius in feet. The injection pressure is limited by the depth at which the injected fluid can first enter the formation, D, in feet. The equation uses the maximum pressure drop, calculated from the maximum injection pressure that would not cause fracturing and with the producer pumped to atmospheric pressure. The maximum pressure drop is given by the product 0.65 pounds per square inch (psi/foot) times D in feet, but the numerical coefficient may vary from 0.55 to 0.75 psi/foot in different formations. Because maximum pressure drops have been used, the rates calculated from the equation are also maximum rates. Results are shown in Example II.

EXAMPLE II

Injection Rates and Project Life*

| 5-SPOT AREA, ACRES | RATE IN BARRELS PER DAY PER 100 FT OF THICKNESS | PROJECT LIFE, YEARS |
|---|---|---|
| 2.5 | 15.5 | 85.6 |
| 1.0 | 16.8 | 31.6 |
| 0.156 | 20.2 | 4.1 |

*Average fluid mobility (k/m) = 30 md/cp, depth to first injection point (D) = 400 feet, formation thickness = 404 feet, oil concentration = 1,117,152 barrels per acre.

For conventional spacing of about 1 acre or larger, it would take over 30 years to potentially sweep the formation. This long life, coupled with the rates, makes such spacings unattractive. This is one reason why the shallow Opal A diatomite formations remain unexploited. For spacings according to the present invention smaller than about 1 acre, the life is shortened to the point that such projects are viable, especially, as shown in Example I, since the well costs per unit of oil-in-place are within conventional limits. Thus, there is a narrow range of well spacings according to the present invention and rates to economically develop hydrocarbon resources such as the Opal A diatomite formation in the McKittrick and similar fields. The non-obviousness of the present invention is indicated, inter alia, by the unsuccessful attempts of the owners of the properties to develop and/or adapt recovery processes for them for decades.

Example II (including the calculations for prior art well spacing and for spacing according to the present invention) is based on a known equation adapted from work by Muskat about 50 years ago. Although it serves quite well to illustrate the interaction between spacing, formation thickness, fluid mobility, and oil concentration, on the injection rate and the life of a project, today such calculations are usually done with numerical simulators, which can include the additional effects of multiple compressible fluids under the effects of gravity and capillary forces, variable pressure differences, damaged zones near wells, selective injection and production intervals, and heterogeneities within the formation. Detailed calculations using more sophisticated numerical simulation methods run by computer yield similar results. But the substance of the numerical results are those already shown in Example II.

Another factor, whose significance was recognized by the present invention, favoring the use of small well spacings and a short project life relates to the dissolution and precipitation of the minerals when it comes in contact with the liquid part of the injected steam, and its condensate. The cumulative effect of repeated or continuous precipitation over a limited distance within the formation can be thwarted by having the project terminated before the plugging is too severe. This is accomplished, according to the present invention, by reducing the project life, i.e., using the smallest spacing and highest possible injection rate consistent with prudent commercial operating practice.

Specific steps such as using unusually high steam qualities and reducing the ability of the injected liquid water to dissolve diatomite minerals, e.g. by controlling its pH and/or its saturation level with respect to the minerals of interest, also help in reducing the plugging effect due to re-precipitation.

Less steam overall is required for systems according to the present invention as compared to steam injection systems used in conventional sandstone or other formations, e.g. Kern River, Etchegoin, Monarch and others because of improved heat utilization. In one aspect, approximately 5 barrels of oil can be produced from thick diatomite oil-bearing formations per equivalent barrel of oil burned to generate steam as compared with just over 3 for thin conventional sandstone reservoirs as calculated using computer numerical simulation. Two of the reasons for this include lower fractional heat losses to the overburden and underburden, and improved vertical and areal conformance obtained at the substantially reduced pattern size.

According to certain embodiments of the present invention, steam is injected at a pressure and rate depending on oil viscosity, formation permeability, depth of the accumulation and the amount of overburden present as discussed above. In one aspect, the steam is injected at between about 10 pounds per square inch (psi) and about 260 psi. The higher pressure value is variable depending on producing strategies and the upper limit of the confining system load. Injection pressures that inhibit or prevent fracture of the diatomite formation are usually linear with the bulk density and the depth of burial (or vertical height) of the overburden, and take into account safety factors and the mechanical strength of the rock in a manner well-known to those skilled in the art. The greater the depth of burial and/or the confining system pressure, the greater is the safe injection pressure. The pressure range from 10 to 260 psi given above is based on 65% between overburden depth and maximum safe pressure (assumes overburdens between 15 and 403 feet), but factors ranging between 55 and 75 percent may be applicable locally and the depth of burial and/or the confining system load can be higher.

In one aspect of the present invention steam is injected at a rate of between about 15 to about 65 BPSD per 100 feet of interval. This estimated range of steam injection rates is calculated for the parameters discussed in Example I and the pressure range discussed above.

For the case of an outcropping accumulation, one aspect of the invention provides for artificially creating an overburden seal by physically placing weighted sealing material as necessary conforming to system design specifications. Design specifications are determined by the desired injection pressure and the system pressure that is to be maintained close to the surface. This includes a system of mechanized vents for bleeding the overall system pressure as the need requires for safety and environmental reasons.

According to the present invention low steam injection rates are desirable due to the shallow depth to the top of the diatomite formation at McKittrick which limits the pressure for steam injection and the relatively viscous oil and the low formation permeability. Certain conventional steam operations at McKittrick have not been considered to be economically attractive, apparently because of low steam injection rates associated with conventional well spacing.

Use of certain relatively small well-spacing patterns, called "Mini-Patterns", disclosed herein according to the present invention results in a high area concentration of wells on the landscape. Individually, these wells rely on lower pressures, lower temperatures, lower injection rates and lower production rates to achieve similar or higher levels of hydrocarbon depletion in the system as compared to most conventional heavy oil operations. Collectively, the wells serve to yield a potentially higher rate of production per unit of developed area than is often the case in a conventional heavy oil operation.

Application of the "mini pattern" concept is discretionary according to the present invention. Variable well spacing system is applicable throughout the development as needed such that wide spacing is used when thick sections of overburden overlie the producing formation; reduced spacing is used when thin sections of overburden overlie the producing formation; and intermediate well spacing variations are used when the overburden thickness ranges between the extremes. Application can depend on various factors such as cost, variations in overburden thickness, and the interactions of production performance of one spacing versus another. The minimum thickness can be established by the artificial overburden thickness and/or the thickness defined by the artificial overburden and actual overburden section overlap thickness which in this case is assumed to be about the same.

An oil recovery operation of this type according to the present invention that utilizes wells equipped in the usual manner may be cumbersome to access and difficult to maintain because of the relative closeness of the wells. One aspect of this invention involves the use of a recessed wellhead to reduce this effect of congestion. A recessed or below-grade wellhead system; a container for a below-grade wellhead; and a wellhead with appropriate covering which can support significant weight, such as the weight of a large truck or other vehicle in a field or area with a plurality of such wellheads alleviates the congestion associated with certain conventional systems and designs. Furthermore, the environment is rendered more pleasing due to the use of recessed installations since conventional surface installations may be perceived as an unsightly gathering of mechanical equipment and thus damaging to the environment. The present invention teaches a variety of reinforced cellars or containers useful with such below-grade wellheads such as prefabricated cement culverts and/or sewage pipes and any other similar low cost container, duct, cellar, and/or construction items.

According to certain embodiments of the present invention lower cost well designs are used that are adapted to lower pressures, lower temperatures, lower injection rates, lower production rates and sometimes shorter life than conventional heavy oil production operations. These factors, individually or in combination, enable the use of reduced well fixture and related piping dimensions and performance ratings resulting in a potentially significant cost savings on a individual well basis. The possible use of alternative well construction materials such as plastics and aluminum for some aspects of the operation is also viable because of relatively low pressures and temperatures associated with shallow operations described herein.

Typically 5 to 6 cubic feet of natural gas and/or other gasses potentially are liberated to the atmosphere when 1 barrel of heavy oil having the approximate characteristics as that seen in the McKittrick diatomite is produced by methods such as strip or open pit mining. In other systems in which pressure on an oil-bearing formation is reduced, e.g. by hydrocarbon production, gas liberation also occurs. Provision of an artificial overburden according to the present invention results in a "closed" system to reduce or eliminate the amount of such liberated gas from venting to the atmosphere, e.g. at an outcrop.

Artificial overburdens according to the present invention provide needed weight to control pressure and needed sealing to prevent the escape of gasses. In certain embodiments the artificial overburden provides a moisture seal and prevents the escape of steam from a formation.

In one aspect the artificial overburden provides a confining load, and in one particular aspect a 37.5 to 56.25 foot deep artificial overburden of soil (e.g. dirt such that a depth of approximately 1.5 to 2.25 feet for each one pound per square inch of system pressure anticipated in diatomite) is used to contain fluids at 20 pounds per square inch with a 50 percent safety factor included for the higher value. This example approximation excludes potentially beneficial loading effects added when the effects of the mechanical properties of rock are considered. In one aspect dirt or soil is added over an existing shallow overburden or over an exposed formation. This is augmented with the use of a sealing material that is placed over a thin layer of impermeable soil on a prepared level section of exposed oil bearing diatomite, followed by a strong dense layer of higher strength material such as reinforced concrete followed by compacted impermeable dirt. For any particular artificial overburden any combination may be made of some or all of the various possible overburden components disclosed herein.

The present invention provides apparatus and methods for implementing well spacing wherein the application of "mini patterns" according to the present invention and variable well spacing are used, in one aspect throughout a field or development as needed such that wide spacing is used when thick sections of overburden overlie a producing formation; reduced spacing is used when thin sections of overburden overlie the producing formation; and intermediate well spacing variations are used when the overburden thickness ranges between the extremes.

It is, therefore, an object of at least certain preferred embodiments of the present invention to provide:

New, useful, unique, efficient, non-obvious devices and methods for the recovery of hydrocarbons by enhanced recovery methods, in one aspect using injected recovery injectant (e.g., but not limited to, steam—saturated or supersaturated) with relatively low injection rates and/or relatively close spacing of injectors and producers;

Such systems and methods in which the quality of the steam delivered to the formation is sufficiently high to maximize process effectiveness within practical and economical considerations,(in one aspect at at least about 85% quality or at at least 91% quality—amount of vapor in the steam, the remainder liquid); and the pH of the delivered steam (in certain embodiments liquid in the steam at a pH between 7.6 and 11.5; in one aspect to maintain diatomite structure and in one aspect to inhibit or prevent the conversion of Opal A to Opal CT) are selected by means of laboratory tests of the oil bearing formation material to reduce and slow the dissolution of the minerals in the formation;

Such systems and methods using an artificial overburden;

Such systems and methods for making a producing field in which wellheads are located below-grade in reinforced chambers or containers; in one aspect with removable covers thereon suitable for supporting vehicles and equipment typically used in producing fields; and Such systems and methods for producing hydrocarbons from a shallow and sometimes outcropping formation; and, in one particular aspect, for producing heavy oil from a diatomite formation.

It is an object of at least certain preferred embodiments of the present invention to provide a producing field as described herein according to the present invention and to provide an artificial seal for a formation and, in one aspect, for a formation which outcrops.

The present invention, in certain embodiments, discloses a method for recovering hydrocarbons from an earth formation containing hydrocarbons, the method including injecting a recovery injectant into the earth formation at a plurality of injection points, the injection points spaced apart by about 14 to about 208 feet, and producing hydrocarbons from the formation with at least one producer well extending into the formation; such a method wherein the injection points are regularly spaced apart in a pattern configuration (e.g., but not limited to known 5-spot and 3-spot patterns, by a distance of about 25 feet to about 150 feet; such a method wherein the at least one producer well is a plurality of producer wells, the producer wells of the plurality of producer wells spaced apart by a distance ranging between about 14 to about 208 feet; such a method wherein the at least one producer well is a plurality of producer wells, the producer wells of the plurality of producer wells spaced apart by a distance ranging between about 25 to about 150 feet; such a method wherein the recovery injectant is steam (saturated or supersaturated) and the earth formation includes a stratum of diatomite and the method further includes injecting steam into the stratum of diatomite at an injection rate of between about 10 to about 149 barrels of steam per day per hundred feet thickness of diatomite; any such method wherein the injection rate of steam is injected at between about 15 to about 65 barrels of steam per day per hundred feet thickness of diatomite; such a method wherein the recovery injectant is steam and the steam is injected at a pressure no greater than about 10 p.s.i. or at a pressure between about 10 p.s.i. and 600 psi. or at a pressure between about 10 psi and about 200 psi; such a method inclduing, prior to the injecting step and when necessary, emplacing an artificial overburden over substantially all of or at least a portion of a surface of the earth formation; such a method wherein the artificial overburden provides a confining load and/or seal on the portion of the earth formation; such a method wherein the recovery injectant is injected with at least one injector at an injection point, the at least one injector having a wellhead, the at least one producer well having a wellhead and reacting to the recovery injectant, and portions of the injector and the producer wellhead each disposed in a single chamber or in a respective chamber or chambers below the surface of the earth formation; such a method wherein each chamber is reinforced with reinforcement apparatus within which the portions of the injectors and the wellhead are positioned; such a method wherein each chamber has a removable cover and the method including moving the removable cover to access contents of the chamber and the removable cover being able to withstand loads such as the weight of a vehicle when necessary; such a method wherein the recovery injectant is steam from a steam generator to which water is fed to produce steam, the method including treating the water fed to the steam generator including filtering the water to remove particles therefrom, and treating the steam piped to the injector, to reduce formation damage; such a method wherein the particles have a largest dimension and the filtering removes particles with a largest dimension of 10 microns or smaller or of 2 miccrons or smaller; such a method wherein the recovery injectant is steam injected at an injection steam temperature into an injection well in the earth formation and the steam is circulated initially through the injection well until temperature at a bottom of the injection well reaches the injection steam temperature; such a method wherein the recovery injectant is steam with a pH between about 7.6 and 11.5; such a method wherein the recovery injectant is steam with a steam quality of at least about 85% or at least about 91%; such a method wherein the plurality of injection points includes at least first, second, third and fourth injection points; the first and second injection points are spaced apart a first distance between about 14 and about 208 feet and the third and fourth injection points are spaced apart a second distance between about 14 and about 208 feet, and the first distance is different from the second distance; such a method wherein the at least one producer well is a plurality of producer wells including at least first, second, third and fourth producer wells; the first and second producer wells spaced apart a first distance between about 14 and about 208 feet and the third and fourth producer wells spaced apart a second distance between about 14 and about 208 feet, and the first distance is different from the second distance.

The present invention discloses, in certain aspects, a method for recovering hydrocarbons from an earth formation containing hydrocarbons, the method including injecting steam into the earth formation at one or a plurality of injection points spaced apart by about 14 to about 208 feet, and producing hydrocarbons from the formation with one or a plurality of producer wells extending into the formation, the producer wells of the plurality of producer wells spaced apart by a distance ranging between about 14 to about 208 feet, the earth formation including a stratum of oil bearing diatomite and the method further including injecting steam into the stratum of oil bearing diatomite at an injection rate of between about 10 to about 149 barrels of steam per day per hundred feet thickness of diatomite, and injecting the steam at a pressure between about 10 p.s.i. to about 260 p.s.i.

The present invention discloses, in certain aspects, a method for producing oil from a diatomite formation, the method including injecting steam into the diatomite formation through an injection well, producing oil from the formation through at least one producing well, and having at least one producing well spaced apart from the injection well by at most about 149 feet.

The present invention discloses, in certain aspects, a method for treating a hydrocarbon-bearing diatomite formation, the method including applying an artificial overburden over substantially all of or at least a portion of the formation; such a method wherein the artificial overburden seals the formation or at least a portion of the formation and the method includes sealing the formation or at least a portion of the formation with the artificial overburden.

The present invention discloses, in certain aspects, an earth formation field for recovering hydrocarbons from the earth formation, the earth formation having an earth surface above it, the field including at least one injector well for injecting recovery injectant into the earth formation, at least one producing well for producing hydrocarbons from the earth formation, at least one, two, three, four or five injector wells per acre of earth surface above the earth formation, and at least one, two, three, four or five producing wells per acre of earth surface above the earth formation; such a field wherein the at least one injector well is a plurality of injector wells between about 14 to about 208 feet apart; such a field wherein the at least one producing well is a plurality of producing wells between about 14 feet and 208 feet apart; such a field wherein the distance between an injection well and an adjacent producer well is between about 10 feet and about 149 feet apart; such a field wherein surface apparatus is associated with each injector well and producer well and the field includes a chamber housing each surface apparatus, each chamber below the earth surface; such a field further inclduing a removable cover on each chamber being able to withstand loads such as the weight of a vehicle or heavy equipment when necessary; such a field wherein the earth formation includes diatomite and the field further comprising an artificial overburden over substantially all of or at least a portion of the earth formation; such a field wherein the at least one injector well is a plurality of injector wells that includes at least first, second, third and fourth injector wells, the first and second injector wells are spaced apart a first distance between about 14 and about 208 feet and the third and fourth injector wells are spaced apart a second distance between about 14 and about 208 feet, and the first distance is different from the second distance; such a field wherein the at least one producing well is a plurality of producing wells including at least first, second, third and fourth producing wells, the first and second producing wells spaced apart a first distance between about 14 and about 208 feet and the third and fourth producing wells spaced apart a second distance between about 14 and about 208 feet, and the first distance is different from the second distance.

The present invention discloses, in certain embodiments, an artificial overburden for allof, substantially all of, or at least a portion of an earth formation containing diatomite, the artificial overburden including an amount of material on all of, substantially all of or at least a portion of the earth formation, in one aspect for sealing all of, substantially all of, or at least a portion of the earth formation and/or for providing a confining load thereon; such an artificial overburden wherein the material is selected from the group consisting of soil, concrete, plastic, rock, and fabric and a combination thereof and may have one, two, three, four, five or more layers of any such material in any combination; and such an artificial overburden with a field including a plurality of producing wells extending through the artificial overburden and spaced apart a distance between about 14 and about 208 feet.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs (including but not limited to the need to develop heavy oil bearing shallow diatomite accumulations) and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments given for the purpose of disclosure, when taken in conjunction with the accompanying drawings. The detail in these descriptions is not intended to thwart this patent's object to claim this invention no matter how others may later disguise it by variations in form or additions of further improvements.

BRIEF DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which hay have other equally effective or legally equivalent embodiments.

FIGS. 5B, 5C, 5D and 5E are schematic views that show producing well heads; the present invention also applies to an injector wellhead.

DESCRIPTION OF EMBODIMENTS PREFERRED AT THE TIME OF FILING FOR THIS PATENT

Figure 1A:
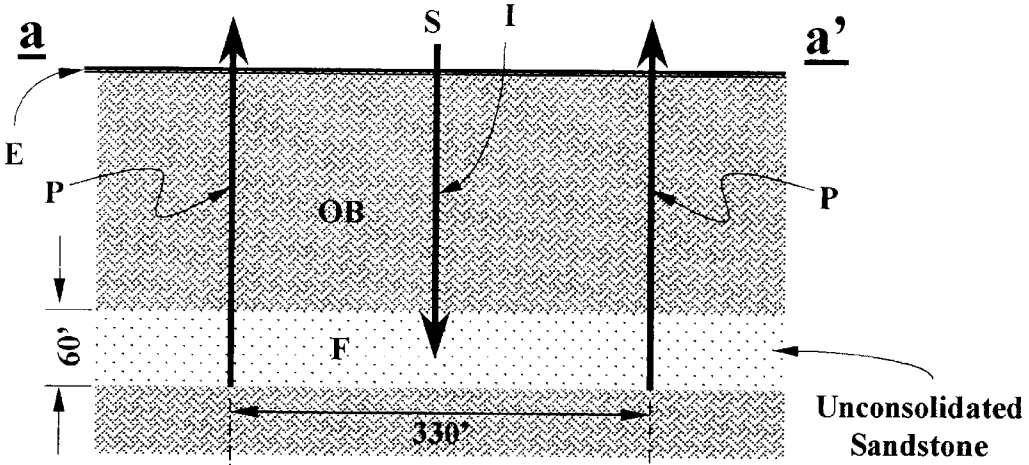
Fig. 1A Prior Art
FIG. 1A is a schematic vertical cross-section view of a conventional oil recovery operation using steam injection.
Figure 1B:
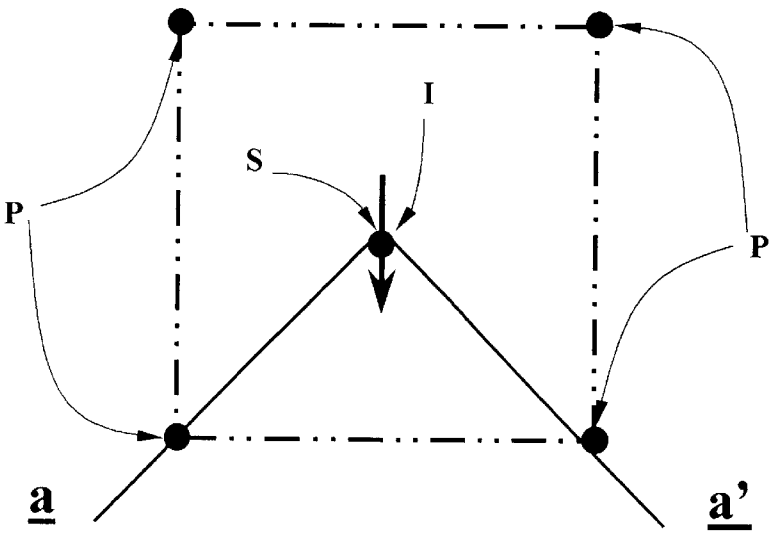
Fig. 1B Prior Art
FIG. 1B is a top plan view of the system of FIG. 1A.

Referring now to FIGS. 1A and 1B, a prior art injection system S, such as steam injection, has an injection well I through which steam is injected into a typical unconsolidated sandstone formation or reservoir F. OB is natural overburden material acting as a confining seal or barrier to vertical movement of the fluids contained in the formation or reservoir F. The reservoir is typically at a depth of about 300 to 3000 feet from the earth surface E to the top of the formation or reservoir F. The top of the formation in this example is about 1000 feet below the earth surface E. This example is about 60 feet thick but can vary from 10 or 20 feet to more than 1000 feet in thickness. In this example, oil is produced from four producing wells P. The distance between producing wells is about 330 feet.

For analytical purposes, the wells designated as I and P can be viewed as elements of a 5-spot 2.5 acre pattern development scheme using contiguous repeated patterns of the configuration shown. The distance from the injection well I to the producing well P is about 233 feet. Similarly, this type of development scheme can employ the use of different pattern configurations and well combinations, e.g. rectangles, hexagons, octagons, etc., as well as, pattern areas ranging from 1 to 20 acres and more.

Figure 2A:
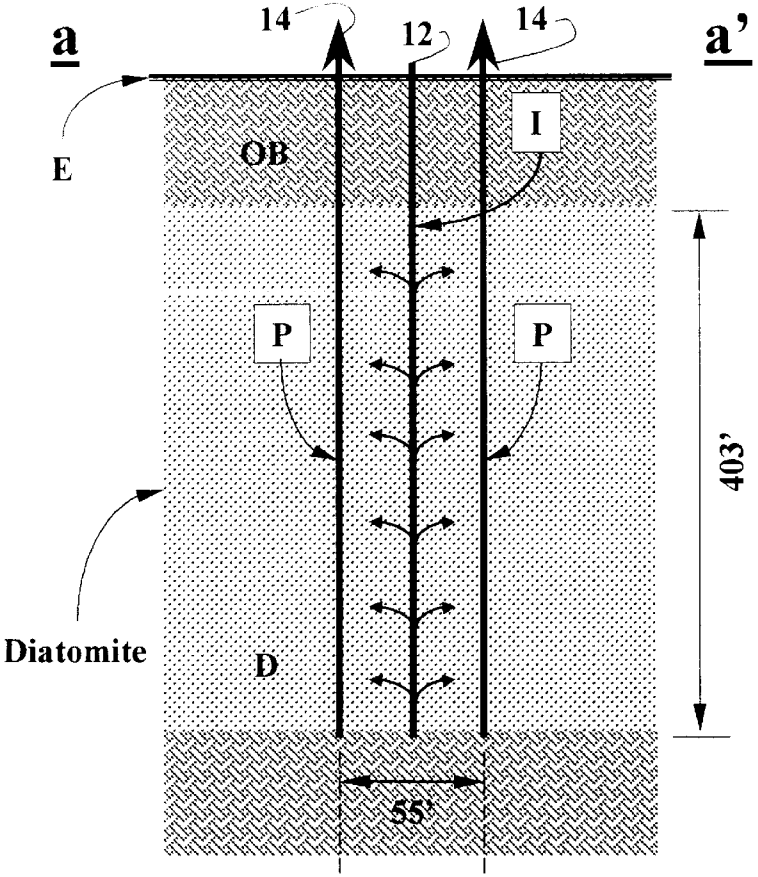
FIG. 2A is a schematic of a reservoir system in vertical cross-section according to the present invention denoting adjusted reservoir dimensions and well spacing that corresponds to an equivalent oil-in-place for an oil accumulation and rock matrix that has higher porosity than the conventional accumulation denoted in FIG. 1A.
Figure 2B:
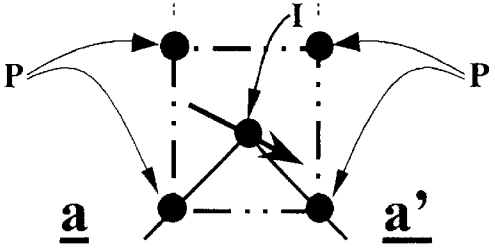
FIG. 2B is a top plan view of the system of FIG. 2A.

FIGS. 2A and 2B show a system according to the present invention for recovering oil from a formation such as diatomite, D, which is about 403 feet thick having a top about 150 feet below the earth's surface E. In this example, an injectant such as steam is pumped down an injection well/injector system 12 and oil is produced from four producing well/producer systems 14. The producers 14 are about 55 feet apart. For analytical purposes, the wells designated as I and P can be viewed as elements of a 5-spot 0.0694 acre pattern development scheme using contiguous repeated patterns of the configuration shown at the top of FIG. 2B. In this case, the distance from the injection well I to the producing well P is about 39 feet. This type of development scheme also can employ the use of different pattern configurations and well combinations, e.g. rectangles, hexagons, octagons, etc., as well as, with pattern areas ranging from 0.01 to 1 acre. The lesser value is usually limited by well vertical deviation control while drilling and cost.

Figures 3, 4:
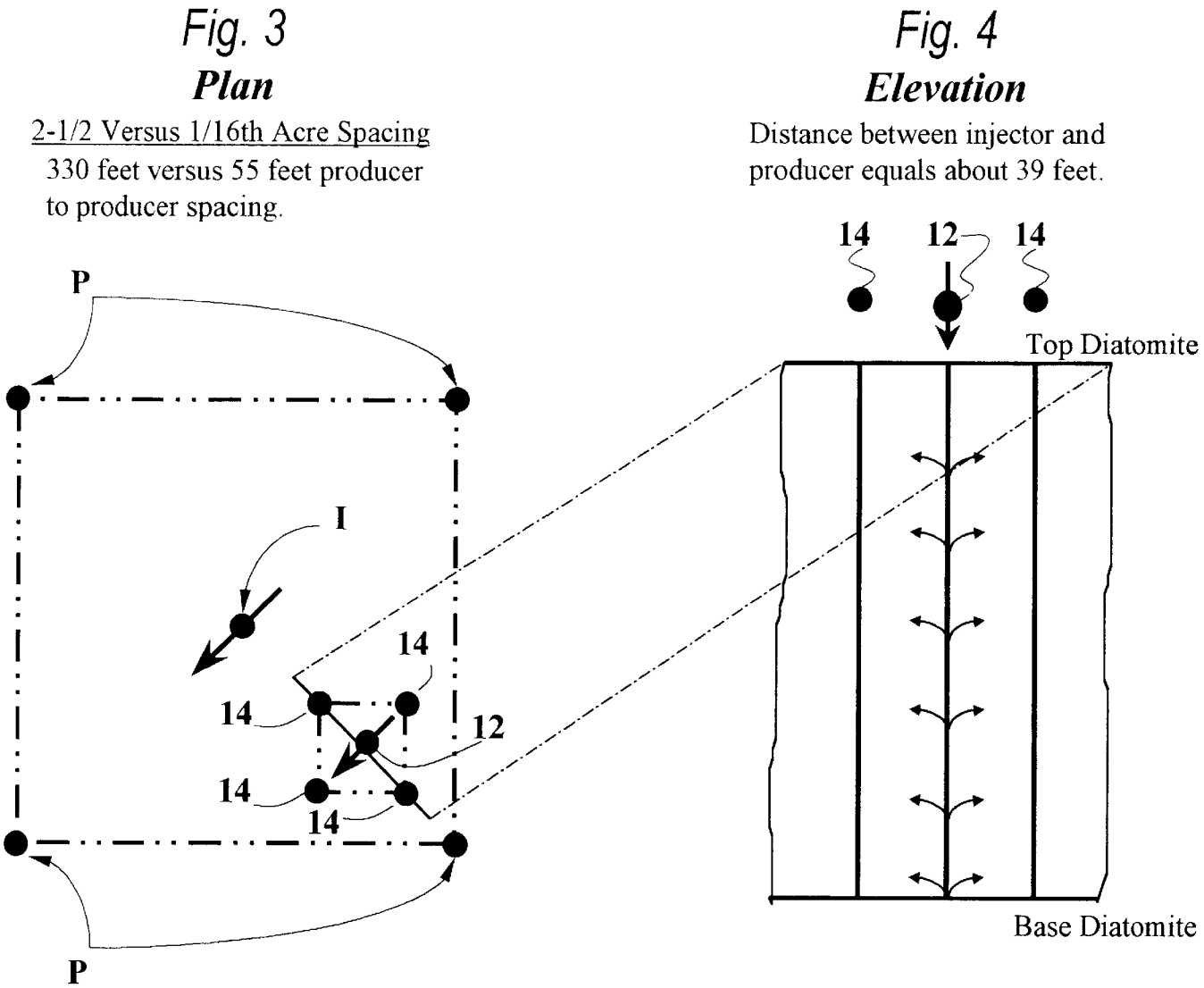
FIG. 3 is a schematic top plan view showing well spacing for the systems like those of FIGS. 1A and 2A where the dots identified as "P" denote conventional producer locations and the outer dashed lines connecting "P" denote an example of conventional well spacing as compared with the inner dashed lines which depict an example of the invention's reduced well spacing.
FIG. 4 is a schematic side cross-section view of injectors and producers for the system according to the present invention shown in FIG. 3.

FIG. 3 presents a graphic comparison of the spacing for the typical five well 5-spot pattern of the prior art system of FIG. 1A and Mini-pattern example of FIG. 2A according to the present invention. In the 5-spot prior art pattern there are four producers P and one injector in a 2½ acre area. Producers P are about 330 feet apart. In the 5-spot Mini-Pattern, four producers 14 and one injector 12 are in each 0.0694 acre (2.5/36), or there are 36 injectors and 36 producers in 2½ acres. Producers 14 in the 0.0694 acre 5-spot Mini-Pattern are about 55 feet apart.

It is within the scope of this invention to utilize Mini-Patterns in an area as small as 0.01 acre and as large as 1 acre. It is within the scope of certain embodiments of this invention for spacing between producers to be as low as 21 feet or as large as 209 feet. In certain aspects well spacing according to the present invention is determined by how quickly it is desired to deplete a given section of the accumulation. Thus, a very specific determination is made to determine what combinations of well spacing, injection rate and pressure will give the desired production response and corresponding producing time given limitations of permeability, viscosity, porosity, thickness, overburden, compaction, effective well radius, compressibility, cost, etc.

FIG. 4 shows the spacing of the injectors 12 and producers 14 of FIG. 3. The distance between an injector 12 and a producer 10 is about 39 feet and the diatomite formation thickness is about 403 feet.

Figure 5A:
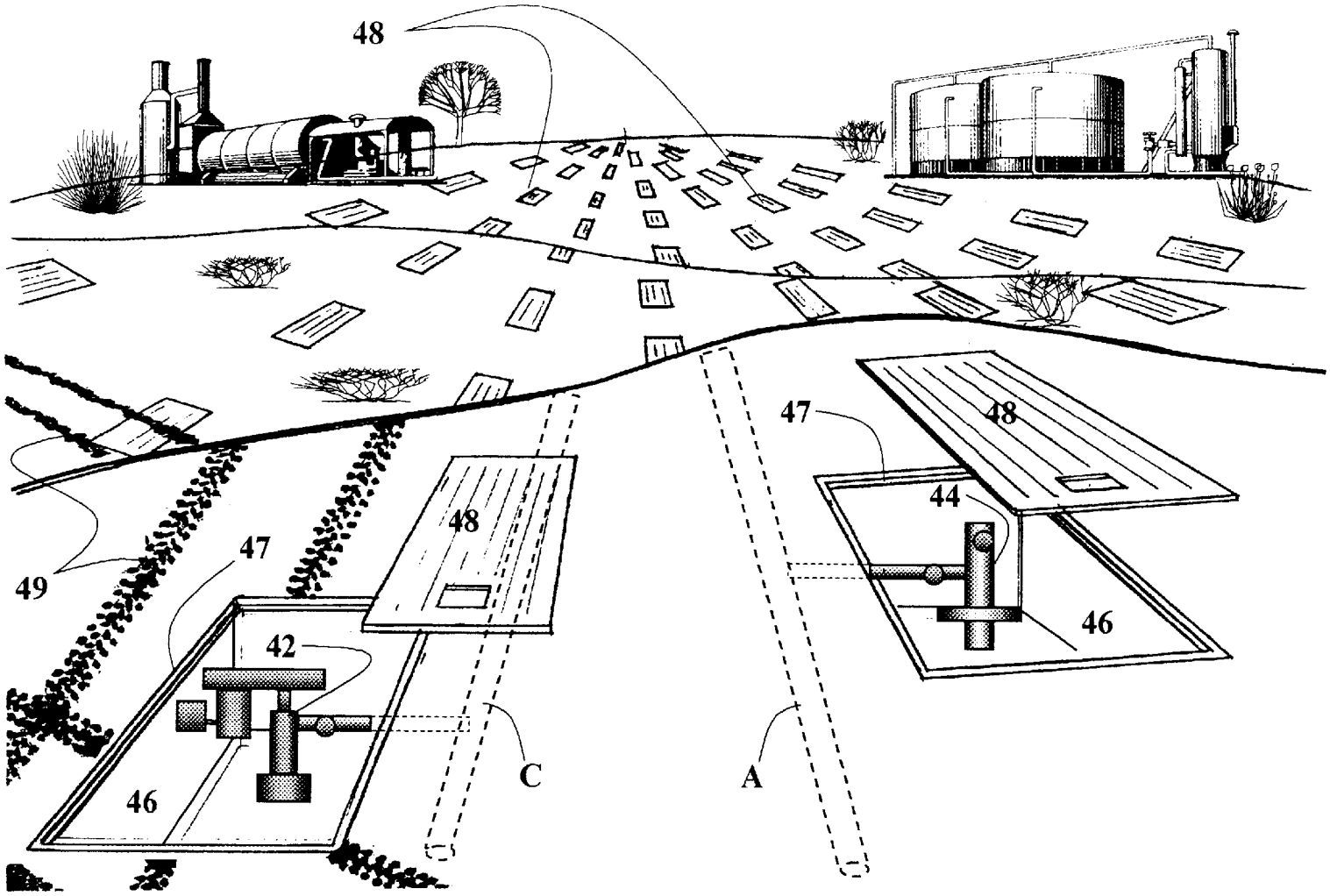
FIG. 5A is a perspective view of a field according to the present invention with below grade wellheads and chambers therefor according to the present invention.

FIG. 5A shows a field 40 according to the present invention with a plurality of below-grade producer wellheads 42 and injectors 44 in below-grade chambers 46. The chambers 46 as shown are reinforced concrete 47. Each chamber 46 has a solid cover 48 which is removably emplaced over the chamber. Preferably the covers 48 are strong enough to support vehicles and other equipment that will move over the field 40 (see vehicle tracks 49). Each producer wellhead 42 is in fluid communication with each other producer wellhead 42 via interconnecting pipes or conduits (not shown) and with a primary collection system/apparatus A. Similarly a central injection system C (shown schematically in FIG. 5A) interconnected with all the injectors 44 provides injectant distribution for one example that is used herein, steam. The chambers 46 may be any desired size and depth and shape, and may be constructed from a variety of different materials and may be reinforced to any degree as deemed necessary by the process. The invention described may or may not involve the use of below grade wellheads and well chambers, but may opt to employ use of above grade installations as dictated by the distance between wells and the need to maneuver vehicles and equipment around them and/or the need to minimize the view of such equipment from public view.

Figures 5B, 5C:
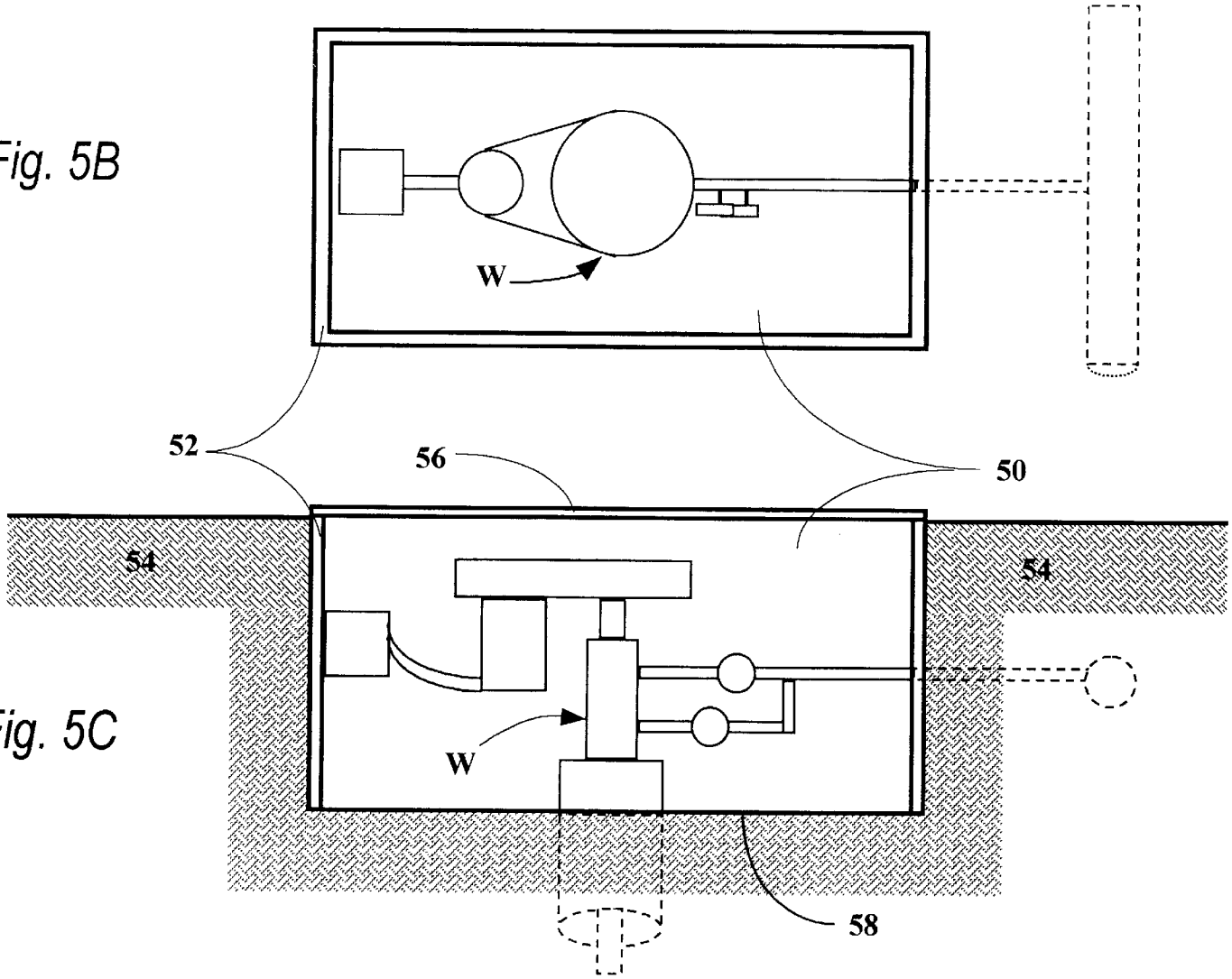
FIG. 5B is a top view and FIG. 5C is a schematic elevation view of a chamber configuration according to the present invention showing use of a rectangular chamber configuration.
Figures 5D, 5E:
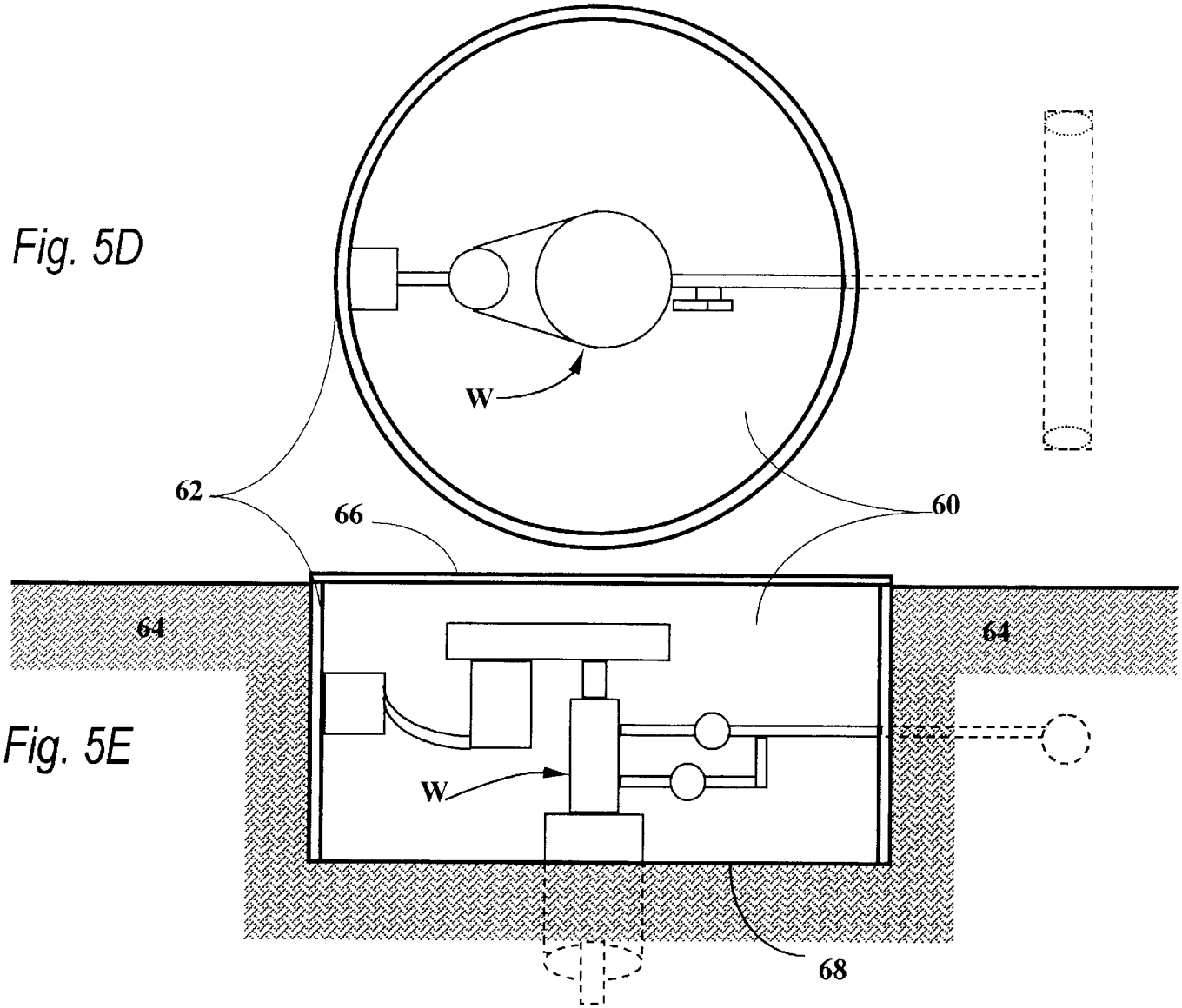
FIG. 5D is a top view and FIG. 5E is a schematic elevation view of a similar chamber configuration according to the present invention showing use of a circular chamber configuration.

FIGS. 5B–5D show views of different chamber configurations 50 and 60 for a producer wellhead W. Such chambers may be used for an injector wellhead I as shown in FIG. 5A. Use of various chamber configurations, either in plan view or in elevation view, is intended as the need for ease of operation dictates. Vertical members 52 and 62 are buried in the soil 54 and 64 and provide for placement of a removable solid cover 56 and 66 and a floor 58 and 68. The chamber dimensions provide for adequate vertical and horizontal clearance to allow for access and maintenance of the equipment contained within. In this case, a soil floor is shown (58 and 68), but may include use of a synthetic or artificial floor.

FIG. 5A shows a plurality of chambers with removable covers 48 at grade level. Each chamber has a producer or an injector wellhead which is part of a system. Alternatively, the chamber can be made of a variety of materials which may be constructed on location and/or prefabricated and transported to the location for installation. For example, chamber materials can make use of a variety of available products such as pre-fabricated conduits and duct sections used to make drainage culverts and sewer systems.

It is within the scope of this invention to provide a pumping system with appropriate sensors to automatically remove liquid material from any chamber of any system disclosed herein if so desired. It is also within the scope of this invention to provide a chamber large enough to enclose an injector and a producer or several nearby wells, whether injectors, producers or both, multiple injectors and/or multiple producers.

Figures 6A, 6B:
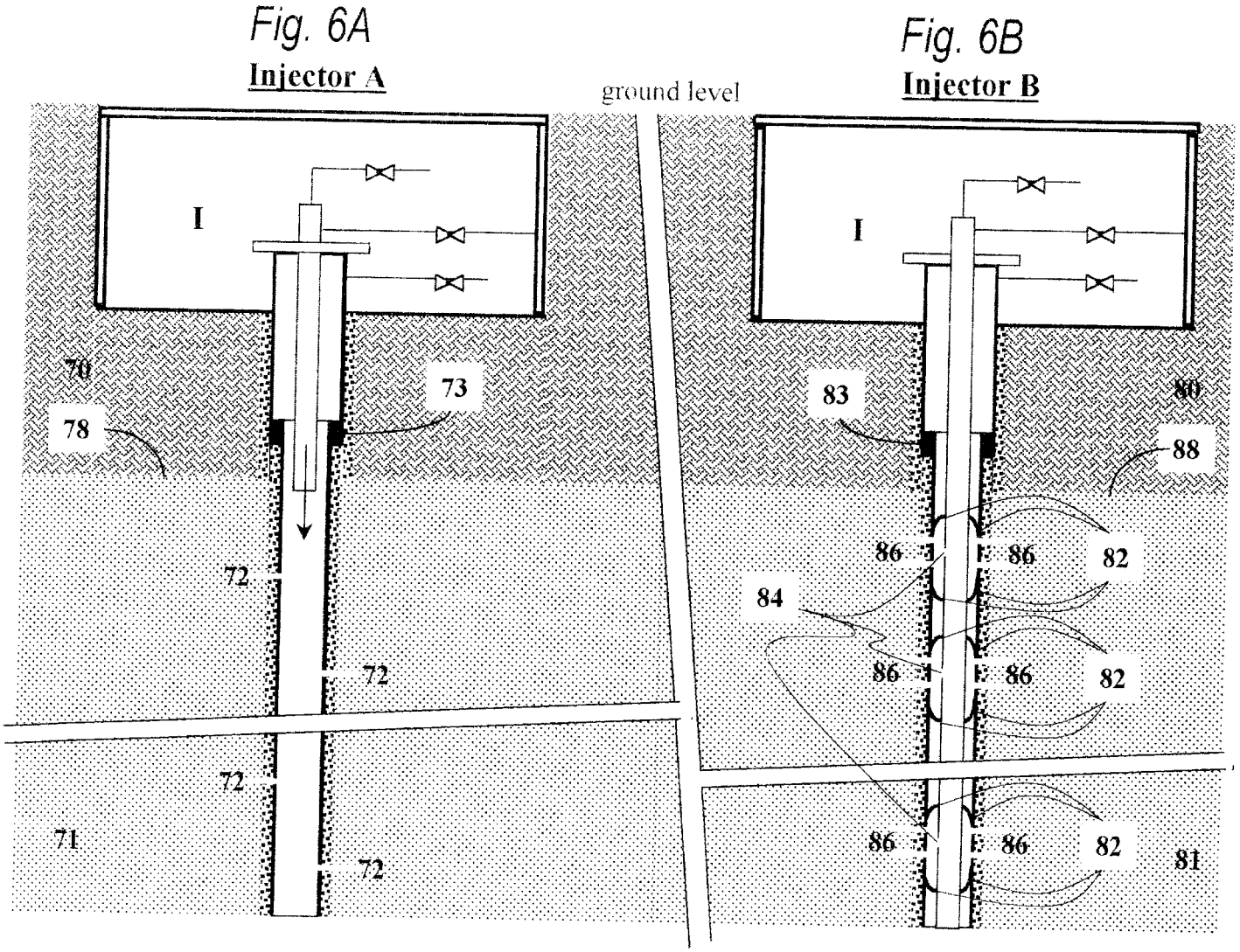
FIGS. 6A and 6B are schematic side cross-section views of two applicable injection well configurations according to the present invention. Other injector configurations are also applicable.

FIGS. 6A and 6B disclose injector systems in chambers according to the present invention. A means for dispersing injected substances to the formation, in this case steam, is illustrated in FIG. 6A and shows an injector I by which a means of regulated flow using the critical flow method through perforations 72 of a predetermined size is used. FIG. 6B shows an injector I using flow regulation that is controlled using an internal string of tubing that incorporates an isolation system comprised of a series of opposed cup packers 82. The injectant, in this case steam, is directed to the formation through pre-sized holes 84 in the internal string of closed ended tubing and then exits into the formation between the system of packers 82 and through the perforations in the casing 86 to the formation. The critical flow method can be used to regulate flow through the pre-sized holes in the tubing 84.

These examples as well as virtually all other injector and flow control systems are compatible with the concept of using below grade chambers including surface flow regulation methods and methods involving the use of mechanical isolation systems within the well such as dual tubing and packer systems.

The present invention includes design considerations for formation compaction effects that are considered by some to be an inherent reaction resulting from the withdrawal of hydrocarbons and the application of heat to a diatomite rock system. Compaction can result as the hydrocarbon bearing diatomite decreases in volume during the recovery operation. When this happens, the vertical measure of formation thickness tends to decrease. This change in dimension tends to apply an undue load onto a continuous casing string that is cemented to the surface and maintains the well's hole stability.

One way to mitigate this problem is to incorporate one or more telescoping sections of pipe that allow for this reaction to occur. FIGS. 6A and 6B show an installation of this type 73 and 83 placed at the overburden and diatomite interface 78 and 88. This and a variety of other existing well components such as the use of strategically placed vertical expansion joints as well as improved versions that provide for lateral or horizontal pipe movement designed specifically for this application are included.

Injector wellheads, valves, tubing, flowlines and all associated equipment are fitted and sized according to injection pressures and rates that are much lower than conventional operations thereby lowering the cost associated with such equipment as compared with a conventional operation. Lower can refer to either rate or pressure and can be 4 to 50 percent of the level normally expected for a conventional operation.

Figure 7:
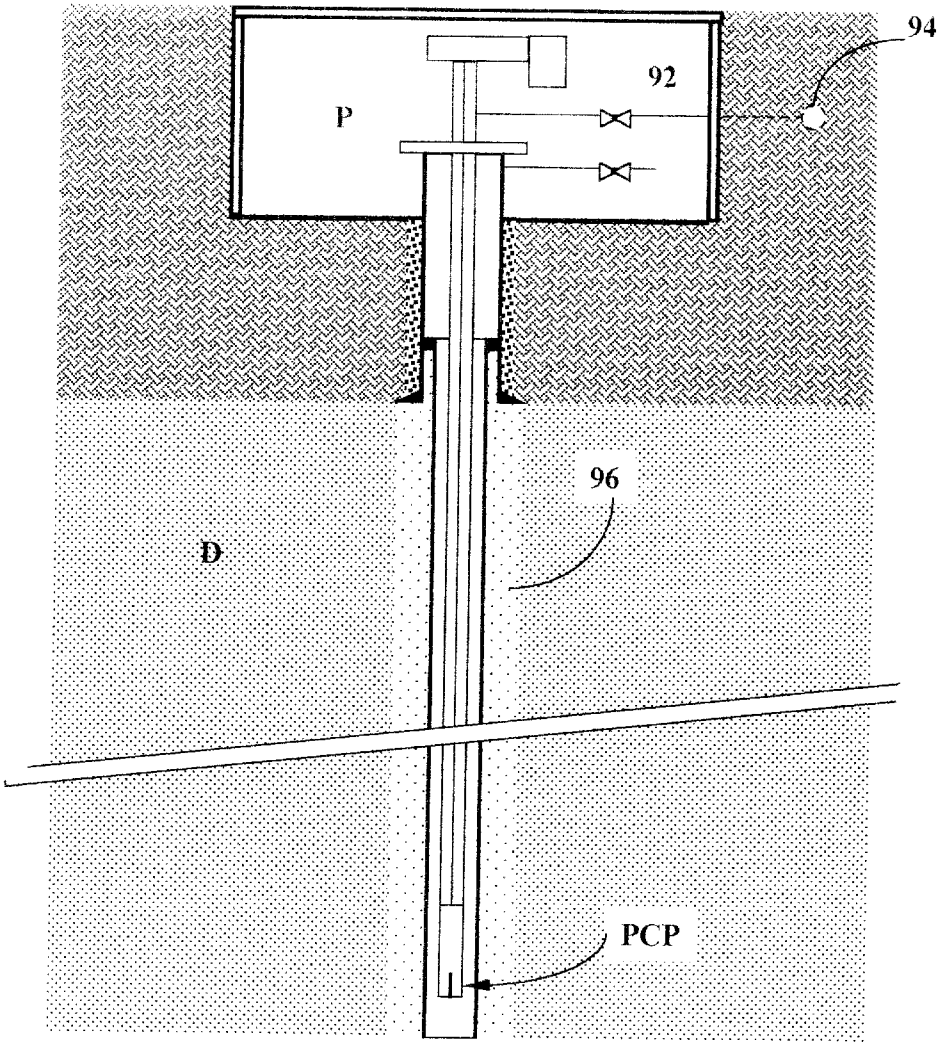
FIG. 7 is a schematic side cross-section view of an applicable producing well according to the present invention. Other producer configurations are also applicable.

FIG. 7 shows a producer P equipped with a progressing cavity pump system PCP and all associated wellhead, flowline, and apparatus placed in a below-grade chamber 92 according to the present invention. Produced fluids flow to a collection flow line 94.

In FIG. 7 the producer P is shown with a gravel pack completion 96. A producer completed with a cemented liner as shown in FIGS. 6A and 6B can also be used. The producer wellheads, valves, tubing, flowlines and all associated equipment of the system of FIG. 7 are fitted and sized according to the pressures and rates that are anticipated and are much lower than conventional operations thereby lowering the cost of associated equipment as compared with a conventional operation. "Lower" can again refer to either rate or pressure and can be 4 to 25 percent of the level normally expected for a conventional operation.

Figure 8A:
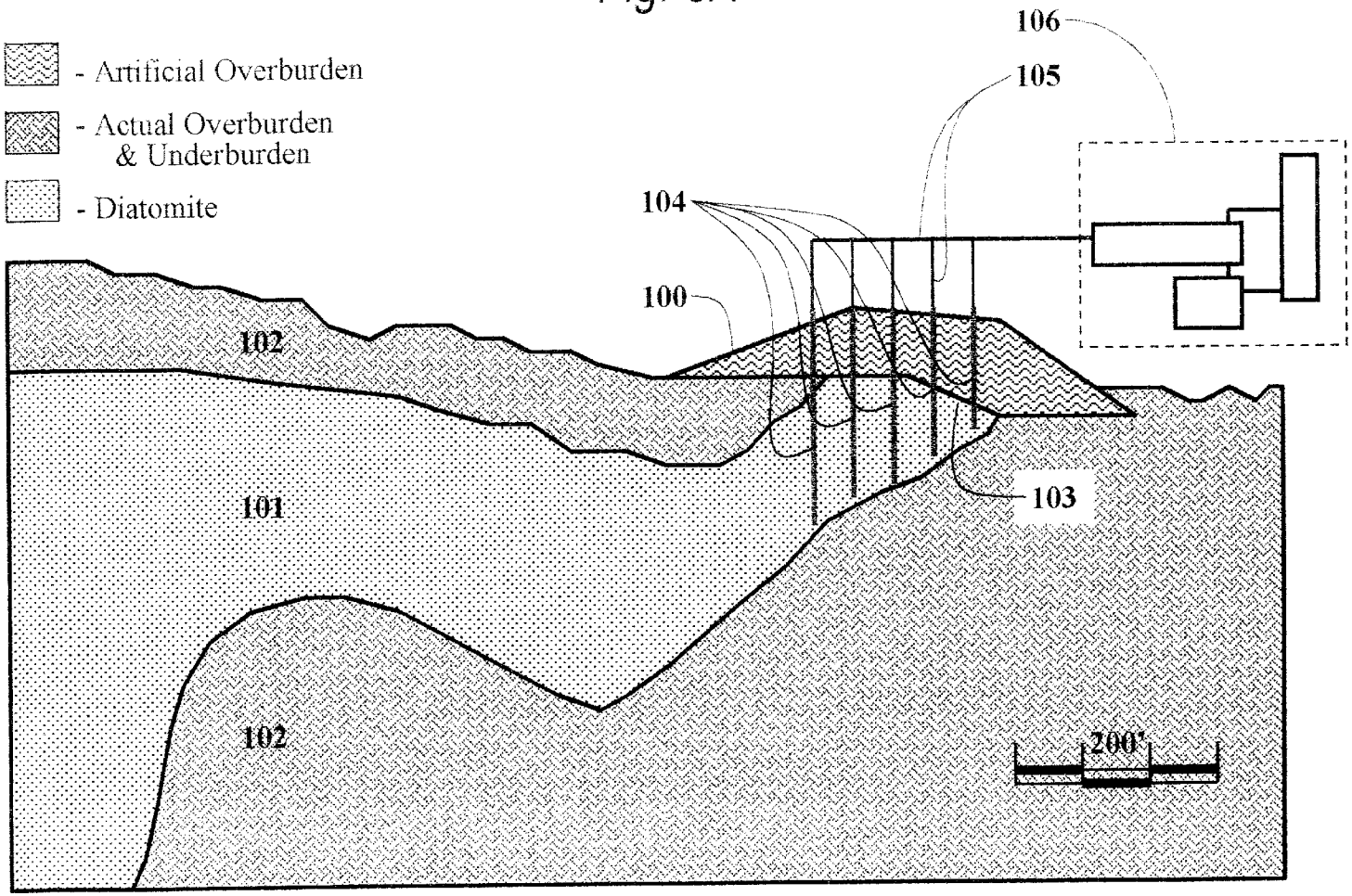
FIGS. 8A–8C are side schematic cross-section views of artificial overburdens according to the present invention.

FIG. 8A shows a typical diatomite formation 101 covered in areas by an overburden 102. An exposed area of diatomite 103 is covered with an artificial overburden or seal 100 according to the present invention. The seal 100 includes provisions for venting and collecting through optional wells or vents 104 any gas and/or liquid accumulations that may build-up during the course of this operation and require removal from the system to limit and control the pressure that may from time to time have to be relieved through a collection system 105 and a treatment system 106. The treatment system components and configuration are dependent on the nature and quantity of the liquids and gases that must be removed. The wells or vents 104 can also serve as system oil producers.

The artificial overburden 100 is of sufficient depth and weight and mechanical competence to prevent the escape of hydrocarbons, steam and/or pollutants such as volatile hydrocarbons and sulfur compounds that might be present to varying degrees and various non-condensing gases such as carbon dioxide and methane, when oil is being removed from the diatomite. Artificial overburdens according to the present invention may be used with any known injection process for recovering hydrocarbons from any known formation(s), including but not limited to, steam.

Figure 8B:
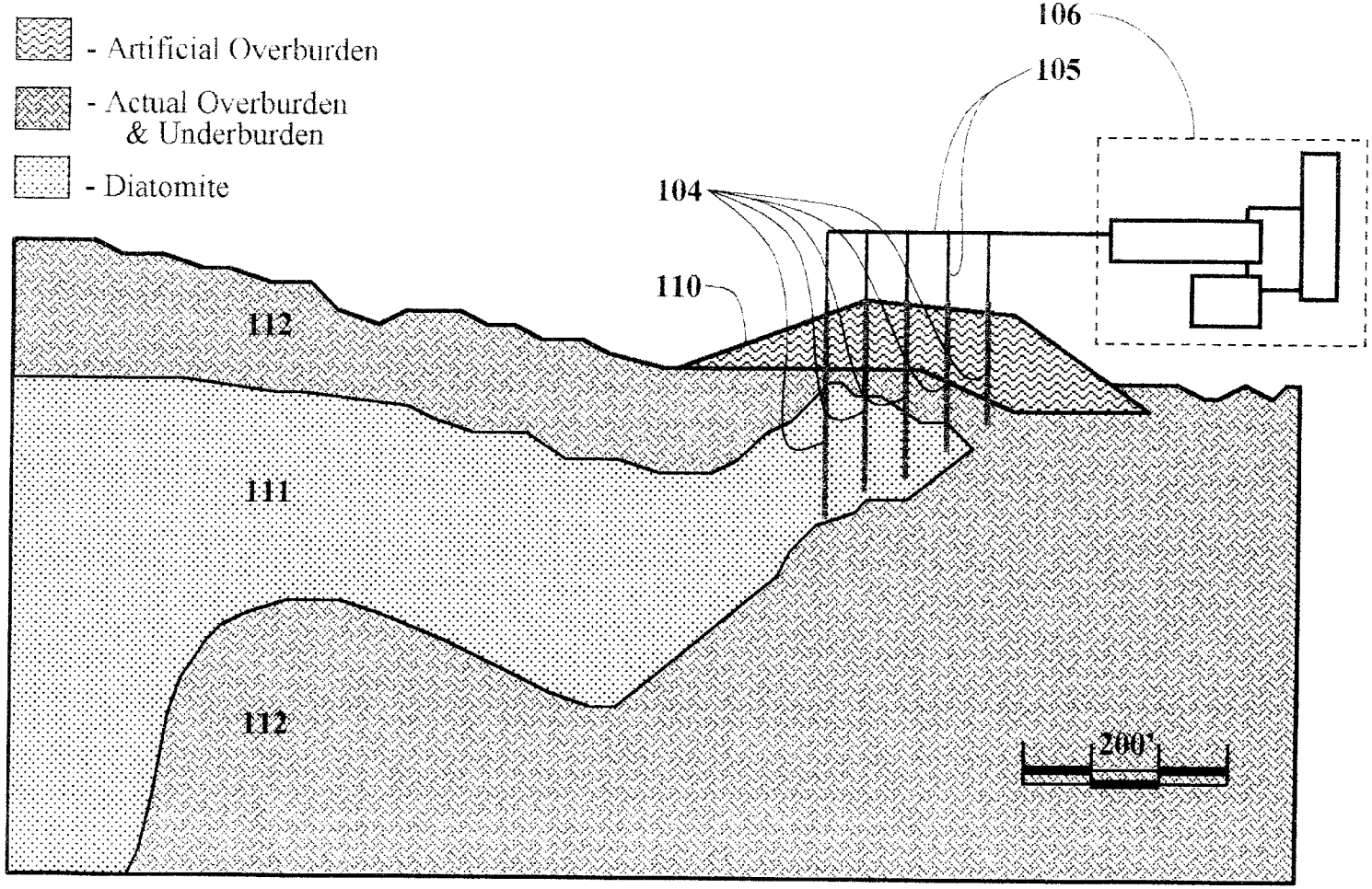

FIG. 8B shows an artificial overburden 110 according to the present invention on top of an actual overburden 112 over a diatomite formation 111. In this case a close to the surface portion of the producing formation has an insufficient cover of natural overburden and is augmented by artificial overburden according to the present invention.

Figure 8C:
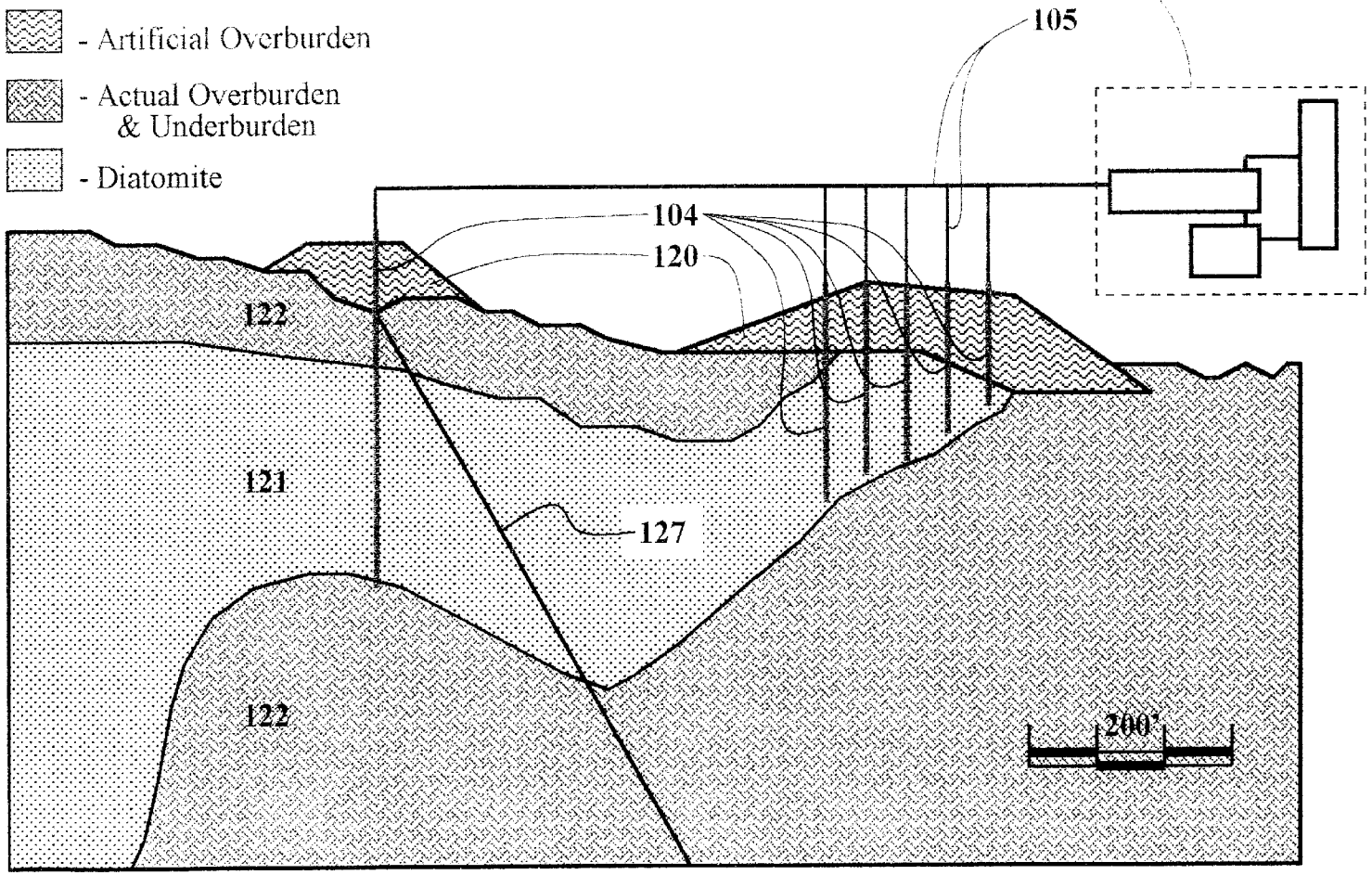

FIG. 8C shows an artificial overburden 120 according to the present invention on top of an actual overburden 122 over a diatomite formation 121 and on top of an exposed fissure or fracture 127. In this case, the artificial overburden acts as a seal of a fracture or fissure that would normally provide a conduit for flow through the overburden to the surface.

Figure 8D:
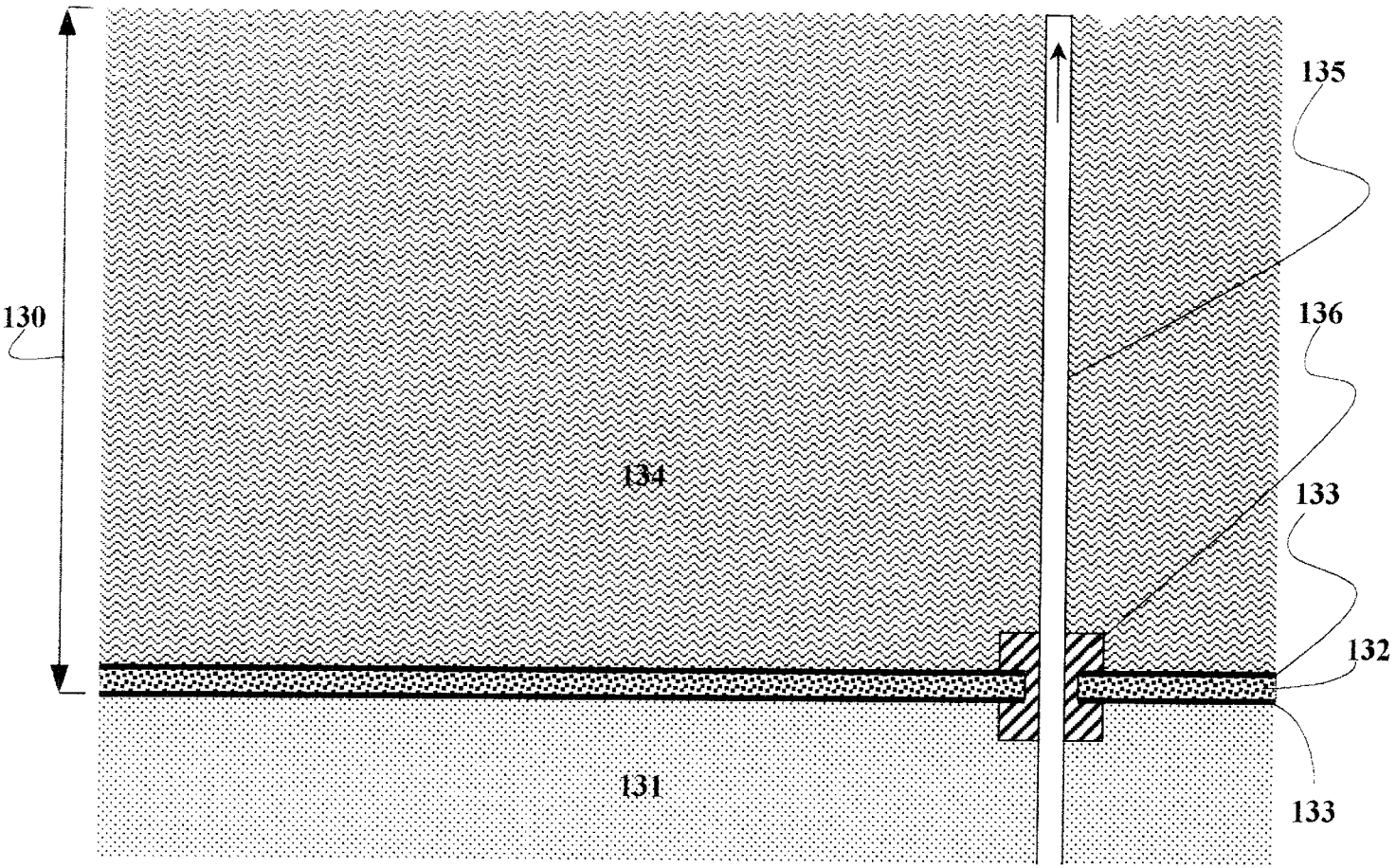
FIG. 8D is a schematic view of an artificial overburden seal and vent system according to the present invention.

FIG. 8D shows an artificial overburden 130 and vent system according to the present invention on a diatomite formation outcrop 131. The artificial overburden 130 includes a layer of sealing material 133, a layer of concrete 132, a second layer of sealing material 133 and an amount of soil or earth material 134. A variety of substances can be used as sealing material 133 for the expected system temperatures of 212 to 280 degrees Fahrenheit. This includes, but is not limited to, tar, synthetic rubber compounds and various resins. The pressure that will tend to build beneath the artificial overburden is controlled by a venting system. Venting is accomplished by purging gases and liquids as needed through vent wells that extend through the artificial overburden and connect the formation with a surface collection system. This system is used as needed to help keep the overall system pressure at an acceptable level.

The venting system may take various forms and/or use a variety of configurations and methods, e.g., use vertical wells 135 and/or horizontal wells and/or slant wells and a seal system 136 between the well and artificial overburden seal. The seal system can use a variety of different arrangements and configurations including but not limited flanged sleeves permanently fixed to the vent tube 135 and bolted to pre-installed fixed points on the artificial overburden and/or pre-installed fixed flanged sleeves fixed to the artificial overburden and the vent tube 135 is screwed into a protruding sleeve. Additionally, the vent wells can also be used as producers in concert with the other designated system producers.

Any artificial overburden layer according to the present invention may be optional, any sequence of artificial overburden layers may be applied, and any combination of artificial overburden layers may be used. An artificial overburden may be used directly on exposed diatomite or other formation or on existing natural overburden considered insufficient to provide the necessary liquid and gas confinement or on leaky fractures, faults, and fissures as needed to confine the liquids and gases and control the withdrawal of produced substances.

Figure 9:
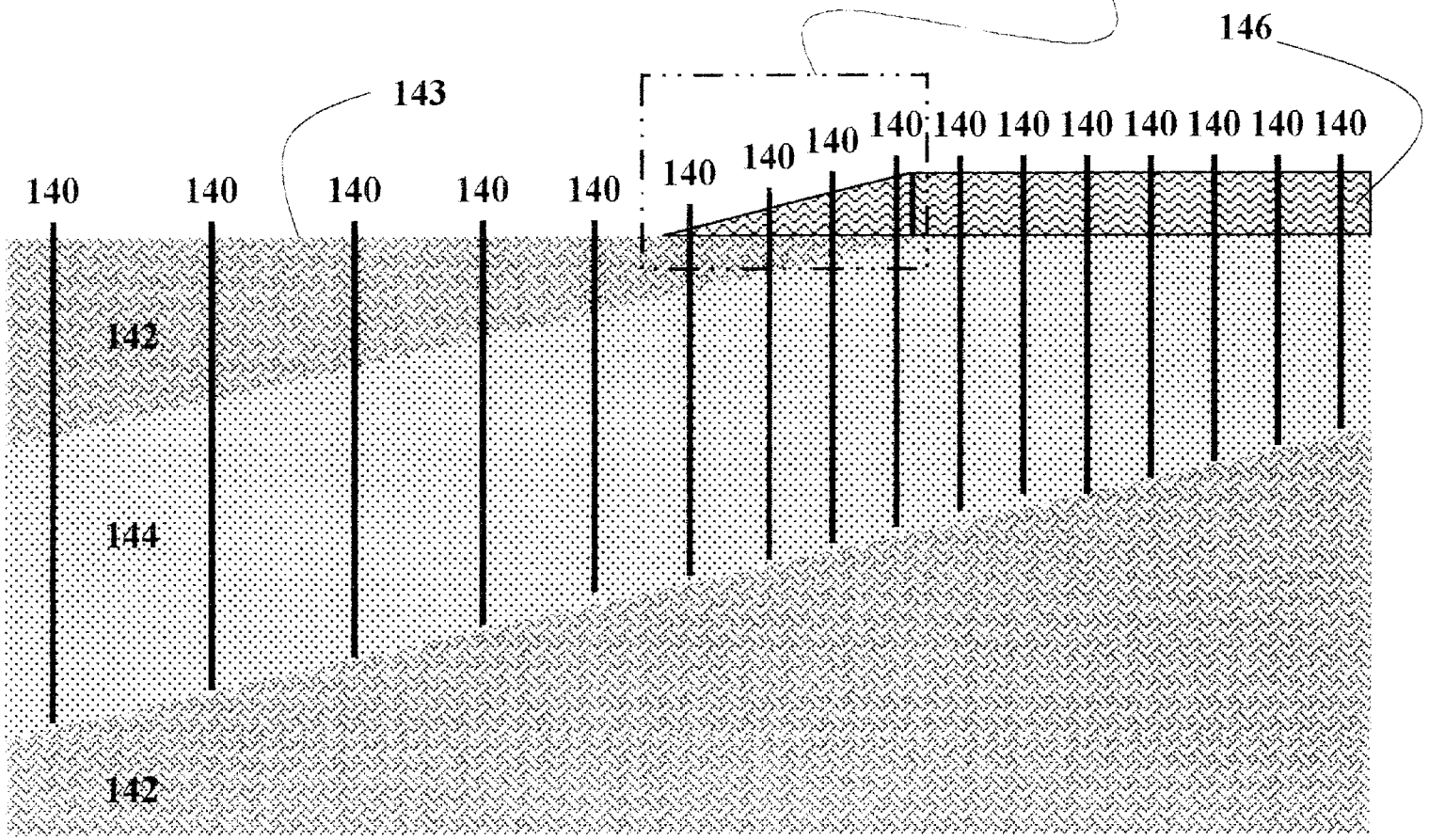
FIG. 9 is a schematic cross-section of a variable well spacing system according to the present invention.

FIG. 9 is a schematic cross-section of a variable well spacing system according to the present invention. Wells 140 are spaced throughout the development as needed such that wide spacing is used when thick sections of overburden 142 overlie the producing formation 144; reduced spacing is used when thin 143 sections of overburden overlie the producing formation; and intermediate well spacing variations are used when the overburden thickness ranges between the extremes. Application of the spacing variation is discretionary and can depend on various factors such as cost, variations in overburden thickness, and the interactions of production performance of one spacing versus another. The example shown in FIG. 9 suggests the minimum thickness can be established by the artificial overburden thickness and/or the thickness defined by the artificial overburden 146 and actual overburden section overlap 148 thickness which in this case is shown to be about the same.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112.

What is claimed is:

1. A method for recovering hydrocarbons from an earth formation containing hydrocarbons, the method comprising emplacing an artificial overburden over at least a portion of a surface of the earth formation, then injecting a recovery injectant into the earth formation at a plurality of injection points, the injection points spaced apart by about 14 to about 208 feet, and producing hydrocarbons from the formation with at least one producer well extending into the formation.

2. The method of claim 1 wherein the injection points are regularly spaced apart in a pattern configuration by a distance of about 25 feet to about 150 feet.

3. The method of claim 1 wherein the at least one producer well is a plurality of producer wells, the producer wells of the plurality of producer wells spaced apart by a distance ranging between about 14 to about 208 feet.

4. The method of claim 1 wherein the at least one producer well is a plurality of producer wells, the producer wells of the plurality of producer wells spaced apart by a distance ranging between about 25 to about 150 feet.

5. The method of claim 1 wherein the recovery injectant is steam and the earth formation includes a stratum of diatomite and the method further comprising injecting steam into the stratum of diatomite at an injection rate of between about 10 to about 149 barrels of steam per day per hundred feet thickness of diatomite.

6. The method of claim 5 wherein the injection rate of steam is injected at of between about 15 to about 65 barrels of steam per day per hundred feet thickness of diatomite.

7. The method of claim 1 wherein the recovery injectant is steam and the steam is injected at a pressure no greater than about 10 p.s.i.

8. The method of claim 1 wherein the recovery injectant is steam and the steam is injected at a pressure between about 10 p.s.i. and 260 psi.

9. The method of claim 1 wherein the artificial overburden provides a confining load on the portion of the earth formation.

10. The method of claim 1 wherein the recovery injectant is injected with at least one injector at an injection point, the at least one injector having a wellhead, the at least one producer well having a wellhead and reacting to the recovery injectant, and portions of the injector and the producer wellhead each disposed in a respective chamber below the surface of the earth formation.

11. The method of claim 10 wherein each chamber is reinforced with reinforcement apparatus within which the portions of the injectors and the wellhead are positioned.

12. The method of claim 11 wherein each chamber has a removable cover and the method further comprising moving the removable cover to access contents of the chamber and the removable cover being able to withstand loads such as the weight of a vehicle when necessary.

13. The method of claim 1 wherein the recovery injectant is steam from a steam generator to which water is fed to produce steam, the method further comprising treating the water fed to the steam generator including filtering the water to remove particles therefrom, and treating the steam piped to the injector, to reduce formation damage.

14. The method of claim 13 wherein the particles have a largest dimension and the filtering removes particles with a largest dimension of 10 microns or smaller.

15. The method of claim 13 wherein the particles have a largest dimension and the filtering removes particles with a largest dimension of 2 microns or smaller.

16. The method of claim 1 wherein the recovery injectant is steam injected at an injection steam temperature into an injection well in the earth formation and the steam is circulated initially through the injection well until temperature at a bottom of the injection well reaches the injection steam temperature.

17. The method of claim 1 wherein the recovery injectant is steam with a pH between about 7.6 and 11.5.

18. The method of claim 1 wherein the recovery injectant is steam with a steam quality of at least about 85%.

19. The method of claim 1 wherein the plurality of injection points includes at least first, second, third and fourth injection points; the first and second injection points are spaced apart a first distance between about 14 and about 208 feet and the third and fourth injection points are spaced apart a second distance between about 14 and about 208 feet, and the first distance is different from the second distance.

20. The method of claim 1 wherein the at least one producer well is a plurality of producer wells including at least first, second, third and fourth producer wells; the first and second producer wells spaced apart a first distance between about 14 and about 208 feet and the third and fourth producer wells spaced apart a second distance between about 14 and about 208 feet, and the first distance is different from the second distance.

* * * * *